US005730056A

United States Patent [19]

Schmitt

[11] Patent Number: 5,730,056

[45] Date of Patent: Mar. 24, 1998

[54] ROTARY PRINTING PRESS WITH A FURTHER PROCESSING UNIT CONNECTED DOWN-LINE THEREFROM

[75] Inventor: Karlheinz Schmitt, Sandhausen, Germany

[73] Assignee: Heidelberger Druckmaschinen AG, Heidelberg, Germany

[21] Appl. No.: 695,703

[22] Filed: Jul. 1, 1996

[30] Foreign Application Priority Data

Jun. 30, 1995 [DE] Germany ..... 195 23 881.8

[51] Int. Cl.[6] ..... B41F 13/24

[52] U.S. Cl. ..... 101/232; 270/17; 270/20.1; 271/277

[58] Field of Search ..... 270/12, 13, 14, 270/15, 7, 8, 20.1, 17; 101/232, 424.1, 233, 234, 235, 236, 237, 238; 293/20–23; 271/277, 204, 205

[56] References Cited

U.S. PATENT DOCUMENTS

| | | | |
|---|---|---|---|
| 3,570,398 | 3/1971 | Mowry | 101/231 |
| 4,409,741 | 10/1983 | Bonomi | 34/162 |
| 4,490,132 | 12/1984 | Ogura et al. | 493/424 |
| 4,530,694 | 7/1985 | Kobler et al. | 493/425 |
| 4,973,040 | 11/1990 | Kemp et al. | 271/277 |
| 5,037,365 | 8/1991 | Breton | 493/18 |
| 5,259,604 | 11/1993 | Schneider et al. | 270/47 |
| 5,405,126 | 4/1995 | Mack | 270/6 |
| 5,439,206 | 8/1995 | Raasch et al. | 270/8 |
| 5,497,987 | 3/1996 | Henn et al. | 271/204 |

FOREIGN PATENT DOCUMENTS

| | | |
|---|---|---|
| 0 212 565 | 3/1987 | European Pat. Off. . |
| 1 302 139 | 3/1970 | Germany . |
| 27 04 813 | 8/1978 | Germany . |
| 29 21 383 | 11/1979 | Germany . |
| 63-009542 | 1/1988 | Japan . |

*Primary Examiner*—Edgar S. Burr
*Assistant Examiner*—Dave A. Ghatt
*Attorney, Agent, or Firm*—Herbert L. Lerner; Laurence A. Greeberg

[57] ABSTRACT

Rotary printing press having a product delivery unit including a conveyor system revolving in a conveyor path, and a further-processing unit disposed downline therefrom and having a product-guiding cylinder for conveying incoming products through the further-processing unit, includes folding modules disposed downline from the delivery unit for performing folding operations on the conveyed products during the conveyance thereof, at least one of the folding modules being integrated with the conveyor system.

6 Claims, 1 Drawing Sheet

ROTARY PRINTING PRESS WITH A FURTHER PROCESSING UNIT CONNECTED DOWN-LINE THEREFROM

BACKGROUND OF THE INVENTION

1. Field of the Invention

The invention relates to a rotary printing press with a further processing unit connected down-line therefrom and, more particularly, having a product-guiding cylinder which conveys incoming products through the further processing unit and performs folding operations on the conveyed products during the conveyance thereof.

2. Description of the Related Art

From the state of the art as exemplified by the published German Patent Documents DE 27 04 813 A1 and DE 29 21 383 A1, for example, rotary printing presses with further processing units connected down-line therefrom have been known for a long time. These cited publications relate, however, to web printing presses wherein one or more webs are printed on one or both sides thereof. The gathering of individual web ribbons generally follows the cross-cutting of the web, so that individual multilayered folded products are formed.

The published German Patent Document DE AS 13 02 139 relates to a device for buckle folding sheets wherein sheets to be folded into buckle plates are introduced through an arrangement of folding and conveying rollers. A disadvantage of such a device is that large tolerances in the folding layer forcibly result due to the principal during the buckle folding.

A device for folding and for outputting sheet-type material has become known heretofore from the published European Patent Document EP 0 212 565 A2. This known device is concerned with a longitudinal folding device, by means of which sheets transported by conveyor belts or tapes in a plane are introduced into a folding-roller nip from which they enter into a substantially vertically disposed belt or tape arrangement for further conveyance.

SUMMARY OF THE INVENTION

It is accordingly an object of the invention to provide a rotary printing press with a further processing unit connected down-line therefrom, which overcomes the above-mentioned disadvantages of the heretofore-known devices of this general type and which realizes a further processing of printed sheets without any interstratification or intermediary in the rotary printing press.

With the foregoing and other objects in view there is provided, in accordance with the invention, a rotary printing press having a product delivery unit including a conveyor system revolving in a conveyor path, and a further-processing unit disposed downline therefrom and having a product-guiding cylinder for conveying incoming products through the further-processing unit, comprising folding modules disposed downline from the delivery unit for performing folding operations on the conveyed products during the conveyance thereof, at least one of the folding modules being integrated with the conveyor system.

In accordance with another feature of the invention, the rotary printing press includes a separate rotary speed-compensating drive operatively associated with at least one of the folding modules.

In accordance with a further feature of the invention, one of the folding modules includes a transfer cylinder to which products are transferable from the revolving conveyor system.

In accordance with an added feature of the invention, the rotary printing press includes another product-guiding cylinder cooperatively associated with the transfer cylinder.

In accordance with a concomitant feature of the invention, the rotary printing press includes blower units disposed on the conveyor path of the revolving conveyor system.

The advantages of the device according to the invention are of a manifold nature. Thus, difficult to handle sheet piles at the delivery-side ends of a sheet-fed printing press are able to be avoided. Furthermore, the provision of appropriate markings for distinguishing specific charges in a sheet pile may then be dispensed with. The copies or printed products successively delivered on a copy or product delivery system can be transported, beforehand in small charges or quantities, to various delivery stations for binding or the like.

For driving at least one of the folding modules, a rotary speed-compensated drive is provided which may be connected as a sequence motor to the main drive of the upline sheet processing machine without any mechanical coupling. Within the scope of the invention, the products affixed to the revolving conveyor system components are transferred to a transfer cylinder in a first folding module. Because sheets are being transported, crosscutting in the folding module is no longer necessary, the cutting cylinder being replaceable by a transfer cylinder. The transfer cylinder cooperates with a folded product-guiding cylinder and passes the products continually supplied by the revolving conveyor system to the folding product-guiding cylinder. Because blower units 14 are provided on the conveying path of the revolving conveyor system components, the surfaces of the sheets, also printed on both sides, are adequately dried before the occurrence of the folding operations.

Other features which are considered as characteristic for the invention are set forth in the appended claims.

Although the invention is illustrated and described herein as embodied in a rotary printing press with a further processing unit connected down-line therefrom, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings, wherein:

DESCRIPTION OF THE PREFERRED EMBODIMENTS

Figure 1:
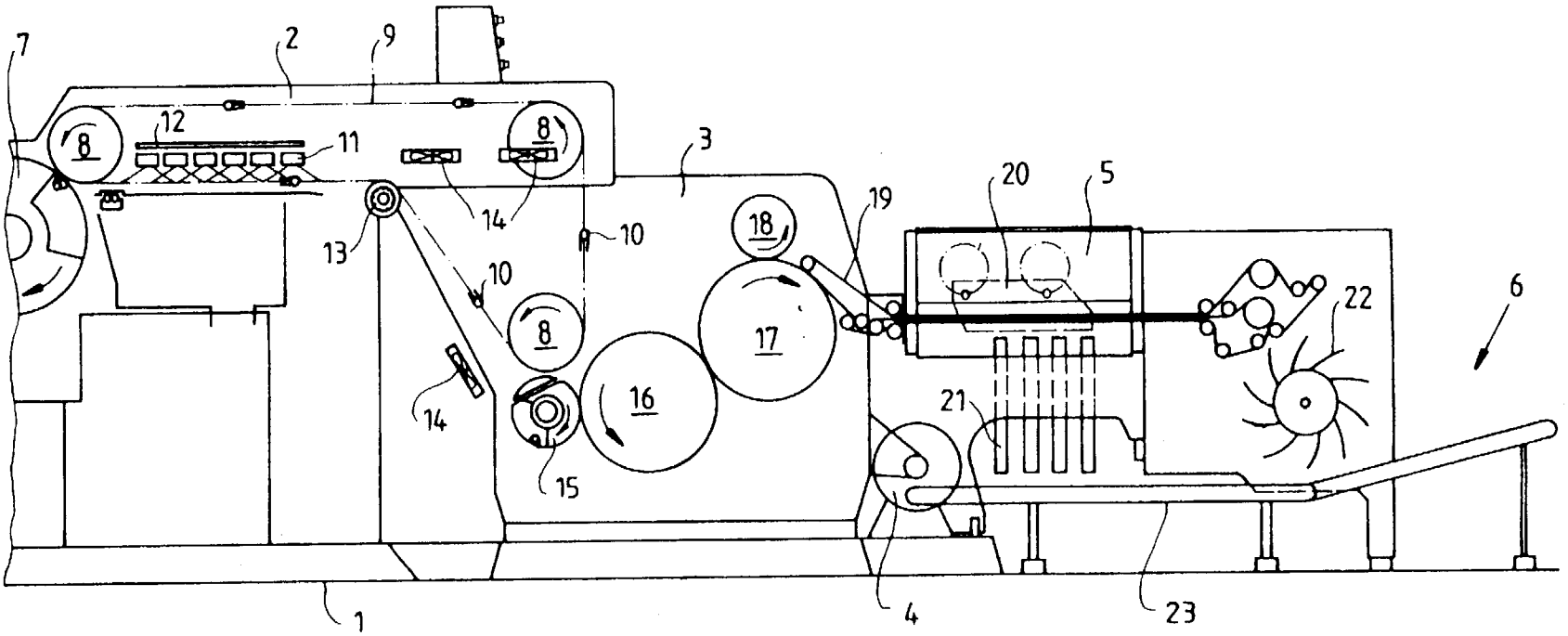
FIG. 1 is a diagrammatic side elevational view of a press configuration incorporating the invention of the instant application.

Referring now to the single figure of the drawing, namely FIG. 1, in detail, there is shown therein a printing-press configuration wherein a delivery 2 is positioned on an adjusting surface 1, and has a somewhat lower constructed crossfold module 3 disposed down-line therefrom. A longitudinal-fold unit 5 is connected to the crossfold module 3. The crossfold module 3 and the longitudinal-fold unit 5 are driven by an independent or separate rotary speed-compensated drive 4 which is disposed between the crossfold module 3 and the longitudinal-fold unit 5.

Products, namely sheets printed on one or both sides thereof, are conveyed by a sheet-guiding cylinder 7 into the delivery 2 wherein they are accepted or taken over by gripper bars 10. The gripper bars 10 are arranged with uniform mutual spacing on revolving gripper chains 9. The gripper chains 9 are guided over three sprocket or chain wheels 8, one of which is located near the sheet-guiding cylinder 7. When the respective sheet to be conveyed is surrendered to a gripper bar 10 deflected by the sprocket wheel 8, the sheet passes a drying device 11 on the conveyor path within the delivery unit 2 which, for example, may be constructed as an ultraviolet (UV) dryer, although of course hot-air or IR dryers are also possible. A cooling device 12 is operatively associated with this drying device 11 and serves for removing heat therefrom. After the sheet has passed the drying device 11, the gripper chains 9 are deflected, at a chain deflector 13 which is disposed at an impact location between the delivery 2 and the crossfold module 3, in a direction towards a sprocket wheel 8 disposed in the crossfold module 3. A transfer cylinder 15 is rotatably supported or journalled below the sprocket wheel 8 in the crossfold module 3 and surrenders the sheets guided thereto by the gripper bars 10 to a first crossfold cylinder.

The gripper bars 10 which have transferred the sheets to the lower sprocket wheel 8 at the transfer cylinder 15 run up empty on a further sprocket wheel 8 in the delivery 2. Several blowers 14 are arranged in the course of guidance or travel of the gripper chains 9 and augment the sheet guidance until the sheets are surrendered in the crossfold module 3.

The printed sheets pass from the transfer cylinder 15 to a first crossfold cylinder 16 which is provided, at the circumference thereof, with chopper or tucker blades and grippers which are not otherwise illustrated and which take over the sheets. In the cylinder nip between the first crossfold cylinder 16 and a jaw cylinder 17, the sheets are thrust by the chopper or tucker blades into folding jaws which are located on the circumference of the jaw cylinders 17. If necessary, a further crossfold may be produced by a second crossfold cylinder 18. By means of tapes 19, the sheets crossfolded then in accordance with the production mode are conveyed into a longitudinal-fold unit 5. Depending upon whether a longitudinal fold is to be produced, the sheets are either longitudinally folded with a knife or chopper fold 20 and are passed by a fan or paddle wheel 21 to the delivery on a conveyor belt 23, or the knife or chopper fold 20 remains at rest, and the sheets which have only been crossfolded are delivered by a further paddle wheel 22 to a copy or product delivery 6.

Thus, a delivery of crossfolded sheets, whether with a double parallel fold or with a delta fold, may follow, and is to be effected selectively by the suitably oriented paddle wheel 22 located downline from the longitudinal-fold unit 5. On the other hand, in the longitudinal-fold unit 5, a longitudinal fold may be formed in the sheets which have been crossfolded in the one or the other manner in the crossfold module 3. The delivery occurred respectively on a conveyor or transport belt 23 of the copy or product delivery 6.

I claim:

1. A sheet-fed rotary printing press having a product delivery unit including a conveyor system defining an endless conveyor path, and a further-processing unit disposed downline therefrom and having a product-guiding cylinder for conveying incoming products through the further-processing unit, comprising:

folding modules disposed downline from the delivery unit for performing folding operations on the conveyed products during the conveyance thereof, at least one of said folding modules being disposed within the conveyor path of the conveyor system, and one of said folding modules having a transfer cylinder to which products are transferable from the conveyor system; and the conveyor system including chains and gripper bars for controlling and transporting sheets from the sheet-fed printing press.

2. Rotary printing press according to claim 1, including a separate rotary speed-compensating drive operatively associated with at least one of said folding modules for synchronizing a main drive of the sheet-fed printing press with said folding modules.

3. Rotary printing press according to claim 1, including another product-guiding cylinder in nipping relationship with said transfer cylinder.

4. Rotary printing press according to claim 1, including blower units disposed on the conveyor path of the conveyor system.

5. Rotary printing press according to claim 1, including a sheet drying device disposed along the conveyor path.

6. Rotary printing press according to claim 5, wherein said sheet drying device is selected from the group consisting of ultraviolet dryers, hot-air dryers and infrared dryers.

* * * * *